US006164631A

United States Patent [19]

Seliminsky

[11] Patent Number: 6,164,631

[45] Date of Patent: Dec. 26, 2000

[54] CARBURETOR WITH ELLIPTICAL VENTURI

[76] Inventor: Ivan Seliminsky, 4343 Clairemont Dr., San Diego, Calif. 92117

[21] Appl. No.: 09/244,516

[22] Filed: Feb. 4, 1999

[30] Foreign Application Priority Data

Jul. 24, 1998 [BG] Bulgaria ..... 102-648

[51] Int. Cl.[7] ..... F02M 9/06

[52] U.S. Cl. ..... 261/44.4; 261/118; 261/DIG. 12; 261/DIG. 23; 261/67; 261/DIG. 56

[58] Field of Search ..... 261/40, 67, 118, 261/44.4, DIG. 12, DIG. 23, DIG. 54, DIG. 56

[56] References Cited

U.S. PATENT DOCUMENTS

| | | | |
|---|---|---|---|
| 2,770,254 | 11/1956 | Bolton | 137/625.48 |
| 3,342,462 | 9/1967 | Mick | 261/23 |
| 3,427,006 | 2/1969 | Oiestad | 261/DIG. 54 |
| 3,582,050 | 6/1971 | Kozak | 261/DIG. 54 |
| 3,898,308 | 8/1975 | Baum | 261/118 X |
| 4,132,199 | 1/1979 | Kuroiwa et al. | 261/67 X |
| 4,136,139 | 1/1979 | Nakamura et al. | 261/67 X |
| 4,144,041 | 3/1979 | Hou | 261/DIG. 54 |
| 4,150,070 | 4/1979 | Hashimoto et al. | 261/67 X |
| 4,454,076 | 6/1984 | Wada et al. | 261/DIG. 56 |
| 4,966,735 | 10/1990 | Lorusso | 261/40 |
| 5,695,693 | 12/1997 | Koizumi et al. | 261/71 |

FOREIGN PATENT DOCUMENTS

| | | |
|---|---|---|
| 826178 | 3/1938 | France . |
| 503321 | 12/1954 | Italy . |

OTHER PUBLICATIONS

1998 Catalog Performance For Harleys, Mar. 1998, pp. 2, 30, 31, 32, Published by Edelbrook Corp. in Torrance, CA.

Hot Bike Magazine vol. 30, No. 4, Apr. 1998, pp. 4, 7, 169–171.

Hot Bike Magazine vol. 30, No. 7, Jul. 1998, pp. 4, 7, 140.

*Primary Examiner*—Richard L. Chiesa

*Attorney, Agent, or Firm*—Luce, Forward, Hamilton & Scripps LLP

[57] ABSTRACT

A twin jet carburetor includes a venturi having an elliptical cross section. Two needle jets and jet needles supply fuel to the airstream, allowing the system to operate as two carburetors in one body, but its overall size is much smaller. The elliptical shape venturi and pair of jets provide improved atomization and satisfy engine requirements at high rpm and wide-open throttle positions.

1 Claim, 1 Drawing Sheet

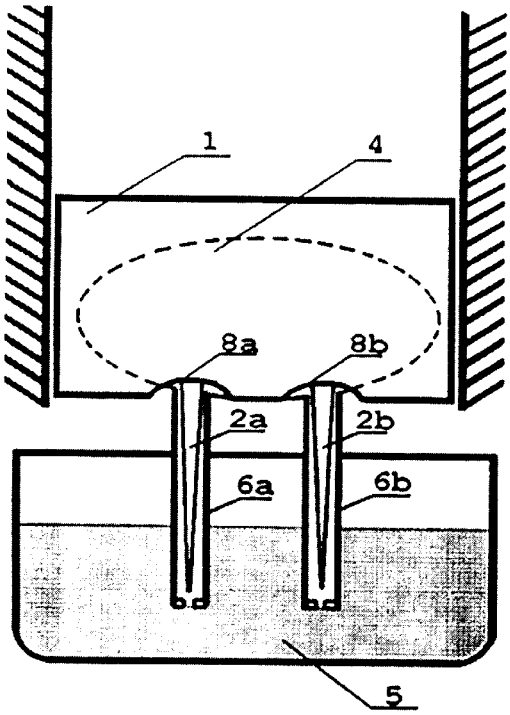
Fig.1
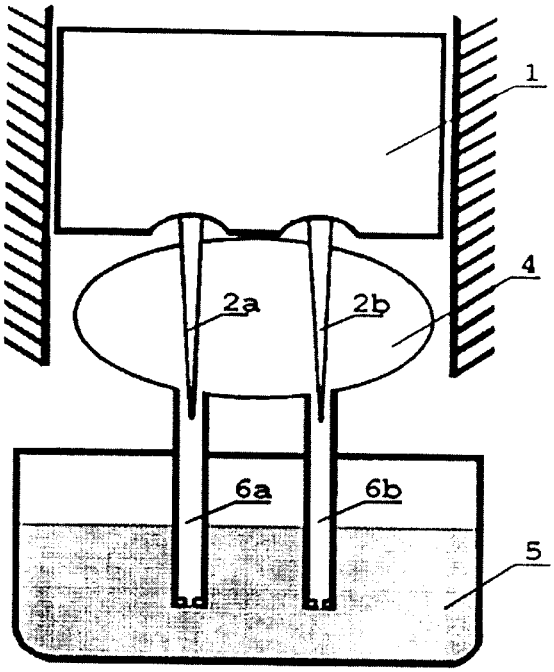
Fig.2
Fig.3
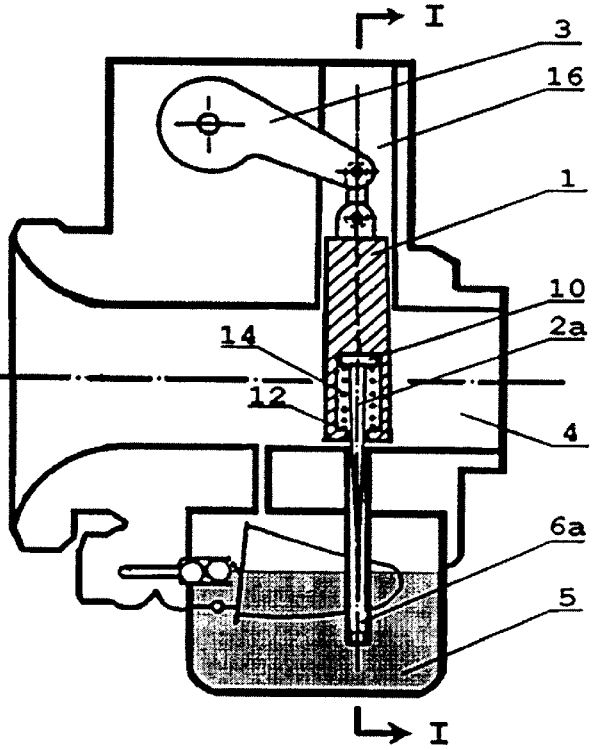

CARBURETOR WITH ELLIPTICAL VENTURI

The present invention is directed to a conduit for mixing gas and fluid, and more particularly to a carburetor for an internal combustion engine.

BACKGROUND OF THE INVENTION

Internal combustion engines operate on the principle of a vacuum induced flow of fuel through a carburetor and into the engine. The carburetor is where air mixes with the fuel to create a flammable vapor or mist that is ignited in the engine. Carburetors are typically self-regulating systems where fuel becomes atomized into an airstream. When the engine runs at higher revolutions per minute (rpm) a greater vacuum is created, causing more air to flow through the carburetor and thus more fuel to be sucked into the air stream. A venturi, or venturi passage, is a channel within the carburetor where air flows to form a relatively low pressure, causing atomization of the fuel being fed to it.

In the prior art, venturi passages are circular in cross section. This shape provides a rather uniform volume through which the air passes. Fuel is typically fed to the venturi from a fuel float chamber by way of a small fuel line. The vacuum created in the venturi pulls the fuel through the line, and when the fuel reaches the venturi, the airstream and low pressure cause the fuel to atomize into a fine spray which is fed to the engine for combustion. For larger engines, such as a single cylinder, large displacement engine or a two cylinder large displacement engine, the prior art sometimes uses two carburetors in order to feed it enough air-fuel mixture.

The air-fuel mixture supplied by the carburetor can be adjusted by way of a throttle. A throttle is a device which can be adjusted to block a desired amount of the carburetor's air passage, thereby limiting the amount of air and fuel that reach the engine.

Fuel injectors are also used in the prior art to supply air-fuel mixtures to engines, and usually can deliver more accurate amounts of fuel. With fuel injectors, the speed of the airstream does not have as much of an effect on the amount of admitted fuel as naturally aspirated carburetors.

BRIEF SUMMARY OF THE INVENTION

The inventor has found a better design for a venturi passage, a design which increases atomization of fuel within the airstream, leading to better engine performance.

It is an object of the present invention to provide a better carburetor for an internal combustion engine. A broader object of the present invention to provide a better conduit for mixing gas and fluid. Still further, an object of the present invention is to provide an improved carburetor which can supply large amounts of an air-fuel mixture to meet engine requirements at high revolutions per minute (rpm) and wide-open throttle settings.

These and other objects are achieved by providing a gas and fluid mixing conduit, comprising a venturi, said venturi having an oval cross section as considered in a plane perpendicular to a direction of flow of gas through said venturi.

The objects of the invention are also achieved by providing a carburetor for mixing air and fuel, comprising a venturi, said venturi having a cross sectional of an ellipse as considered in a plane perpendicular to a direction of flow of gas through said venturi, the ellipse having a minor axis that is one-half of the major axis; two needle jets for supplying fuel to said venturi for mixture with air; two jet needles, each jet needles being movable into and out of a respective one of said two needle jets for controlling flow of the fuel through said needle jets; and a throttle plate positioned at said venturi for controlling flow of air through said venturi, said jet needles being attached to said throttle plate.

A venturi passage having an elliptical cross section and two needle jets for supplying fuel to the venturi, wherein the needle jets are disposed next to one another in a direction transverse to the direction of air flow also satisfies these and other objects of the present invention.

Further scope of applicability of the present invention will become apparent from a review of the detailed description and accompanying drawings. It should be understood that the description and examples, while indicating preferred embodiments of the present invention, are not intended to limit the breadth of the invention since various changes and modifications within the spirit and scope of the invention will become apparent to those skilled in the art.

BRIEF DESCRIPTION OF THE DRAWINGS

The present invention will become more fully understood from the detailed description given below, together with the accompanying drawings which are given by way of illustration only, and thus are not to be construed as limiting the scope of the present invention. In the drawings:

FIG. 1 shows a cut away view of a carburetor according to a preferred embodiment of the present invention, with a throttle in a closed position.

FIG. 2 shows a cut away view of a carburetor according to a preferred embodiment of the present invention, with a throttle in an open position.

FIG. 3 shows a side view of FIG. 1 together with additional components of the carburetor.

DETAILED DESCRIPTION OF THE PREFERRED EMBODIMENTS

The present invention provides a carburetor for mixing air and fuel for subsequent ignition in an internal combustion engine. The present invention will find additional applicability, however, to other fields in which a gas must be mixed with a fluid, and therefore this description encompasses the broader concept of a gas and fluid mixing conduit. It should also be understood that the term fluid as used in this description refers to the substance that is mixed with the gas in the conduit, even though the fluid can take the form of an atomized mist, an evaporated vapor, a gas or even a powdered solid without straying from the spirit and scope of the present invention.

With reference to FIG. 1, there is shown a portion of a carburetor according to a preferred embodiment of the present invention, having a throttle plate 1 blocking an elliptical venturi passage 4. The elliptical venturi passage extends, at the same dimensions, for a certain length as best seen in FIG. 3. Attached to the throttle plate 1 are two jet needles 2*a*, 2*b* which, in FIG. 1, are disposed within respective needle jets 6*a*, 6*b*. Needle jets 6*a*, 6*b* are fuel lines between a float bowl assembly 5 and the venturi passage 4. The float bowl assembly 5 is connected to a fuel supply (not shown) such as a vehicle's fuel tank, and contains enough fuel such that the ends of the needle jets are submersed in the fuel. The float bowl assembly 5 is preferably shared by both jets 6*a*, 6*b*.

FIG. 2 shows the carburetor of FIG. 1, but with the throttle plate 1 in an open position. As can be seen in FIG. 3, the plate 1 can move within a channel 16 between its open and closed positions, or any desired position in between.

In operation, air travels through the elliptical venturi passage 4 in a direction into the page of FIG. 1, or left-to-right in FIG. 3. Because of the moving air, a lower pressure is created in the venturi passage 4 resulting in fuel being sucked from the fuel float chamber 5 through the needles jets 6*a*, 6*b* into the venturi passage 4. Upon reaching the venturi passage 4, the airstream atomizes the fuel into a fine mist (not shown) so that an air-fuel mixture exits the venturi on its way to the internal combustion engine where it is ignited.

The throttle plate 1 is, in a preferred embodiment, linearly movable between the end positions shown in FIGS. 1 and 2 by a mechanism 3 shown in FIG. 3 to be on the opposite side of the plate 1 than float bowl assembly 5. The operation of the throttle moving mechanism 3 is known to those skilled in the art and need not be elaborated in this description. Suffice it to say that, depending on the user's desire for more power from the engine, the throttle will be moved to a more open position so that more air and fuel are supplied. Other types of throttle moving mechanisms can also be used with the present invention, such as constant velocity (CV) mechanisms. The throttle does not necessarily have to move in a plane perpendicular to the air flow path, although that is preferred.

Two curved cut-outs 8*a*, 8*b* are shown in the throttle plate 4 and are preferably provided to prevent air and fuel from being completely cut off from the engine. That is, even in its closed position, the throttle plate 1 preferably supplies some air to the engine through cut-outs 8*a*, 8*b*, and the cut-outs also prevent the jets 6*a*, 6*b* from being completely sealed.

The two jet needles 2*a*, 2*b* are connected to the throttle plate 1 in a spring-loaded fashion as shown in FIG. 3, although they can also be rigidly connected thereto. The artisan will recognize that alternative designs for the throttle plate and jet needles can also be used with the present invention, and that they need not be connected to each other as in the preferred embodiment. In the figures, each needle 2*a*, 2*b* has a head portion 10 which is disposed within a groove 12 in the throttle plate 4, and is pressured against a distal wall by a spring 14. The groove 12 preferably has a more narrow region near the edge of the throttle plate 1 so that the needles 2*a*, 2*b* cannot fall out in the event that the spring 14 fails. For ease of manufacture, the groove 12 can extend the entire width of the throttle plate 1, or two grooves can be used, each extending from the needle's mounting position to a respective side edge.

The cross section of the venturi 4 perpendicular to a direction of flow of the air through the venturi is elliptical. It is preferably exactly elliptical, although inexact ellipses and other ovals are also contemplated by the present invention. Most preferably, the ellipse has a major (longer) axis "2*a*" and a minor (shorter) axis "2*b*" having size and ovalness relationships as follows:

$$\text{eccentricity}=(3^{1/2}/2)$$

$$b=0.5a$$

The eccentricity of an ellipse is the measure of ovalness of an ellipse, and is the ratio, e, of the distance from its center to one of its foci, or c, to the distance from the center of the ellipse to one of its vertices, or a. That is, e=c/a. Oblong or imperfect ovals, and ellipses other than those identified above are also encompassed by the present invention.

The two jets and needles are preferably positioned at distances of one third (⅓) of the length of the major axis from the vertices, as shown in FIGS. 1 and 2. It is preferable that they be parallel to each other, that they be positioned symmetrically relative to one another in the ellipse, and that they both lie in a plane that is perpendicular to the direction of air flow within the venturi. The two needles increase fuel supply and improve fuel atomization. These two conditions in combination are the key for good performance in a carburetor. The elliptical shape to the venturi allows for the use of larger intake venturis, which leads to better engine performance. The elliptical shape in combination with the two jet needles supplies a good amount of fuel and significantly improves atomization. Optimum atomization is possible due to the greater distance between the two needle jets. If more than one jet were used with circular carburetors, then they would be too close together for the limited space and extra fuel delivery could not be accomplished. The elliptical shape of the present invention allows the jets to deliver more fuel efficiently, and finds particular use in big single-displacement cylinders and big twin engines, especially motorcycle engines.

The shape of the needles 2*a*, 2*b* is such that a larger proportion of each jet is open when the throttle plate 4 is open. This allows more fuel to be supplied when more air is passing through the venturi. A long conical shape is a preferred shape for the needles, as they mesh well with the preferred cylindrical shape of the jets. It is also preferable for the two needles to be similar in size and shape so that the two jets supply the same amount of fuel as each other. However, the present invention also contemplates different size needles. One needle can have a different conical (or other) shape such that different amounts of fuel are supplied. The needles can also be shaped to supply identical amounts of fuel for a certain range of openness of the throttle plate, and different amounts outside of that range. That is, the needles can be identical in shape over one portion thereof, and have a different size or shape over the remaining portion such that, for a predetermined range of motion of the throttle plate 4 the two jets supply identical amounts of fuel to the venturi, whereas outside of the predetermined range the two jets supply different amounts of fuel relative to one another. Instead of or in addition to size/shape differences in the needles, the size and/or shape of the jets can also be different in order to supply different amounts of fuel.

The artisan will recognize that the elliptical shape of the venturi according to the present invention also permits more than two jets, of either the same or different sizes, to supply fuel to the airstream. A single jet can be used, but that is less preferable.

The above describes the preferred implementation of the present invention, but the appended claims are in no way limited to or by this preferred embodiment, and as such the full scope and spirit of the invention should be gleaned from the entirety of this disclosure and not from any particular portion hereof. It will be obvious that the present invention may be varied in many ways, not only in construction but also in application. Such variations are not to be regarded as a departure from the invention, but rather as modifications encompassed within the scope of the claims. For example, more or less than two jets can be used to supply fuel to the airstream; a jet can lie in a plane other than perpendicular to the airstream; jets need not be parallel to one another, although a symmetrical orientation relative to the ellipse is preferred; the jet-and-needle type of fuel supplier can be replaced by other types of fuel suppliers; the ellipse can increase or decrease in size and/or change in shape along the length of the venturi passage. The present invention also need not be limited to naturally aspirated carburetors, but can also be applied to forced-air systems.

What is claimed is:

1. A carburetor for mixing air and fuel, comprising:

a venturi having a elliptical cross section as considered in a plane perpendicular to a direction of flow of gas through said venturi, the elliptical cross section having a minor axis that is one-half of the major axis;

two needle jets for supplying fuel to said venturi for mixture with air;

two jet needles, each jet needle being movable into and out of a respective one of said two needle jets for controlling flow of the fuel through said needle jets; and a throttle plate positioned at said venturi for controlling flow of air through said venturi, said jet needles being attached to said throttle plate.

* * * * *